US006104009A

United States Patent [19]

Man

[11] Patent Number: 6,104,009

[45] Date of Patent: Aug. 15, 2000

[54] ELECTRICAL APPLIANCE HAVING USER PROXIMITY SENSOR

[75] Inventor: Yeung Wai Man, Kowloon, Hong Kong, China

[73] Assignee: HP Intellectual Corp., Wilmington, Del.

[21] Appl. No.: 09/206,387

[22] Filed: Dec. 7, 1998

[51] Int. Cl.[7] ..... H05B 1/02

[52] U.S. Cl. ..... 219/492; 219/253; 219/518; 219/508; 219/501; 340/572

[58] Field of Search ..... 219/250–253, 219/518, 492, 493, 501, 506, 508, 509; 340/573, 575, 574; 38/82, 88–90

[56] References Cited

U.S. PATENT DOCUMENTS

| | | |
|---|---|---|
| 1,284,104 | 11/1918 | Heylman . |
| 2,382,587 | 8/1945 | Thomas . |
| 2,470,532 | 5/1949 | Thomas . |
| 3,424,894 | 1/1969 | Schwartz et al. . |
| 3,492,459 | 1/1970 | Schwartz . |
| 3,611,345 | 10/1971 | Pintell . |
| 4,100,485 | 7/1978 | Rogers . |
| 4,103,222 | 7/1978 | Phillips et al. . |
| 4,130,955 | 12/1978 | Baugmgartner et al. . |
| 4,203,101 | 5/1980 | Towsend . |
| 4,366,366 | 12/1982 | Ekblad . |
| 4,520,257 | 5/1985 | Schwob et al. . |
| 4,577,424 | 3/1986 | Liu . |
| 4,661,685 | 4/1987 | Contri . |
| 4,673,798 | 6/1987 | Contri et al. . |
| 4,686,352 | 8/1987 | Nawrot et al. . |
| 4,692,589 | 9/1987 | Borsari et al. . |
| 4,727,240 | 2/1988 | Provolo et al. . |
| 4,745,260 | 5/1988 | Albinger, Jr. et al. . |
| 4,803,342 | 2/1989 | Steers et al. . |
| 4,833,297 | 5/1989 | Del Fresno . |
| 4,885,571 | 12/1989 | Pauley et al. ..... 340/573 |
| 4,906,924 | 3/1990 | Zannis . |
| 4,950,987 | 8/1990 | Vranish et al. . |
| 5,006,798 | 4/1991 | Matsuki et al. . |
| 5,039,843 | 8/1991 | Müller . |
| 5,120,934 | 6/1992 | Nakada et al. . |
| 5,160,831 | 11/1992 | Thaler et al. . |
| 5,233,914 | 8/1993 | English . |
| 5,345,060 | 9/1994 | Hazan et al. . |
| 5,349,160 | 9/1994 | Hazan et al. . |
| 5,380,983 | 1/1995 | Cavada et al. . |
| 5,391,859 | 2/1995 | Hazan et al. . |
| 5,463,205 | 10/1995 | Sham et al. . |
| 5,493,089 | 2/1996 | Chasen et al. . |
| 5,595,672 | 1/1997 | Sham et al. . |
| 5,637,931 | 6/1997 | Hsu . |
| 5,719,379 | 2/1998 | Huang et al. . |
| 5,852,279 | 12/1998 | Mak et al. . |

FOREIGN PATENT DOCUMENTS

| | | |
|---|---|---|
| 523794A1 | 1/1993 | European Pat. Off. . |
| 2806808A1 | 8/1979 | Germany . |
| 3702361A1 | 7/1987 | Germany . |
| 61-263498 | 11/1986 | Japan . |
| 61-280896 | 12/1986 | Japan . |
| 63-206298 | 8/1988 | Japan . |
| 1-107800 | 4/1989 | Japan . |
| 1-190400 | 7/1989 | Japan . |
| 3-21300 | 1/1991 | Japan . |
| 4-114699 | 4/1992 | Japan . |
| 1733542A1 | 5/1992 | U.S.S.R. . |

*Primary Examiner*—Mark Paschall
*Attorney, Agent, or Firm*—Barry E. Deutsch

[57] ABSTRACT

An electric clothes iron with circuitry for automatically disabling power to the iron when the iron is left unattended for a certain period of time. The circuitry includes a circuit for controlling two timing periods, one for controlling the shut off when the iron is in the horizontal position, and one for controlling the shut off when the iron is in the vertical position. When the user grasps the handle of the iron, the timing circuits are disabled. However, once the user removes his hand from the iron, one of the two timer periods starts to expire. If the timer reaches its prescribed limit before the handle is again grasped, the iron will automatically shut off. If the user grasps the iron during the timing process, the timer will be disabled, and will start the counting from zero the next time the hand is removed from the handled.

18 Claims, 9 Drawing Sheets

ELECTRICAL APPLIANCE HAVING USER PROXIMITY SENSOR

The present invention relates to heating devices and, in particular, to an electric clothes iron that shuts off automatically. More particularly, the invention relates to an iron including an automatic shut off device having an orientation switch and a timer cooperating with a handle sensor for detecting the presence of an operator's hand to shut off the iron.

BACKGROUND OF THE INVENTION

Conventional clothes irons include a handle and a heated sole plate. The sole plate is pressed against fabric to remove wrinkles. The iron may also have a heel upon which the iron can rest when it is not in use. The heel allows the iron to sit in a vertical position where the heated sole plate is not in contact with the fabric or an ironing board.

The sole plate of a typical iron usually becomes very hot. Thus, there is a danger that leaving an iron unattended can result in fire or serious damage to the clothing or ironing board. The danger is greatest when the user leaves the iron on and unattended for a long period of time.

To reduce this risk, some irons have automatic shut off devices. The automatic shut off device disconnects the power supplied to a sole plate heater when the iron has not been in use for a prescribed period of time.

Some automatic shut off devices use two separate timing periods to determine when the power should be removed from the sole plate heater. A first timing period is selected for the condition when the iron is left in the vertical position where it is resting on its heel with the sole plate perpendicular to the ironing board. A second timing period is selected for the condition when the iron is left unattended in the horizontal position where it is resting on its sole plate. The first timing period is typically a relatively long time, perhaps ten to fifteen minutes. Since the danger is greater when the sole plate is left in the horizontal position on the clothing or ironing board, the second timing period is typically much shorter, usually around thirty to sixty seconds.

Various arrangements have been devised to determine when the iron is in use and when each timing period should be actuated. For example, some irons use motion sensors or accelerometers. When the iron is moved by the user, the motion sensor, typically a mercury switch, repeatedly resets the automatic shut off timer so that power will not be removed from the sole plate heater when the user is operating the iron. A disadvantage of this type of iron is that it automatically shuts off when held motionless by the user. Such an iron also may not function properly on a non-level surface. Also, chemicals harmful to the environment, such as mercury, are used in many of these motion sensors.

Magnetic switches have also been used to detect when the iron is in use. An example of a magnetic switch is described in U.S. Pat. No. 4,803,342 (Steers). Steers describes the use of a swinging magnet to control timers. Steers has the disadvantage of not providing for an automatic shut off of the iron in the event it is left on its heel for an extended period. Another disadvantage of this type of iron is that the magnet may become demagnetized, thereby preventing the device from operating properly.

Photosensors have also been used to determine if an iron is in use. Typically, a photosensor is placed at a position on the handle of the iron that is covered by the user's hand when the iron is in use, thereby preventing light from reaching the photosensor. A disadvantage of this type of iron is that the iron will remain on if anything blocks the light.

Finally, proximity sensors have been used to determine the user's presence near the iron. A proximity sensor detects the user's presence by sensing the electrical coupling between a user's body and an electrically radiating unit within the iron. Such an iron is shown in U.S. Pat. No. 5,380,983 ((Cavada). Cavada discloses an antenna located in the handle of the iron that serves to conduct a current in conjunction with the user's hand. Cavada's antenna lines the entire inner surface of the iron handle. The current formed by this antenna is then used to control timers consisting of series connected flip-flops. When the user's hand is in proximity to or grasping the handle, a displacement current is formed which resets the flip-flops. The output of the circuit is an amplified square wave signal when the hand is touching the handle of the iron. This square wave signal is applied to the reset pins of the plurality of flip-flops, which prevents them from counting. When the hand is removed, the current stops flowing and the flip-flops begin to count. One disadvantage of Cavada's proximity sensor is that it requires the entire handle to be lined with metal. Another disadvantage is that the use of square wave signals requires substantial circuitry.

SUMMARY OF THE INVENTION

The present invention overcomes these disadvantages and others by providing an iron having a timer circuit and a time period selector switch electrically coupled to the timer circuit. A sensor is disposed in the handle and is electrically coupled to the timer circuit for sensing the presence of a user's hand. The selector switch changes state to select a specified time period of the timer circuit in response to the inclination of the iron, and the user's hand supplies current to the gate of a Field Effect Transistor (FET). The current resets the specified time period.

According to one aspect of the invention, the iron has a first inclination and a second inclination and the time period selector switch selects a first time period when the iron is in the first inclination and a second time period when the iron is in the second inclination. The second time period is substantially longer than the first time period, with the first time period being about thirty seconds and the second time period being about fifteen minutes.

In preferred embodiments, the time period selector switch includes a coil switch that is electrically coupled to the timer circuit for selecting a specified time period of the timer circuit. The coil switch includes a first coil disposed adjacent a second coil and selects a first time period when the iron is in a horizontal orientation and a second time period when the iron is in a vertical orientation. The first coil includes a first hollow core and the second coil includes a second hollow core. The coil switch further includes at least one member disposed in one of the hollow cores and movable between the hollow cores. The first coil induces a first signal in the second coil when the movable member is disposed in the first hollow core and a second signal when the movable member is disposed in the second hollow core. According to one aspect of the invention, the first signal includes a logical one input to the timer circuit and the second signal includes a logical zero input to the timer circuit. Based on the input to the timer, the timer selects a specified time period.

In other preferred embodiments, the time period selector switch includes a pendulum switch that is electrically coupled to the timer circuit for selecting the specified time period. The pendulum switch selects a first time period when the iron is in a horizontal orientation and second time period when the iron is in a vertical orientation. The pendulum switch includes a pendulum stand, a pendulum, and a contact. The pendulum is supported by the pendulum stand and is spaced apart from the contact when the iron is in the horizontal orientation. The pendulum is disposed against the contact when the iron is in the vertical orientation.

Other aspects and advantages of the present invention will be readily apparent from the following description and drawings which illustrate preferred embodiments of the invention.

DETAILED DESCRIPTION OF PREFERRED EMBODIMENTS

Figure 1:
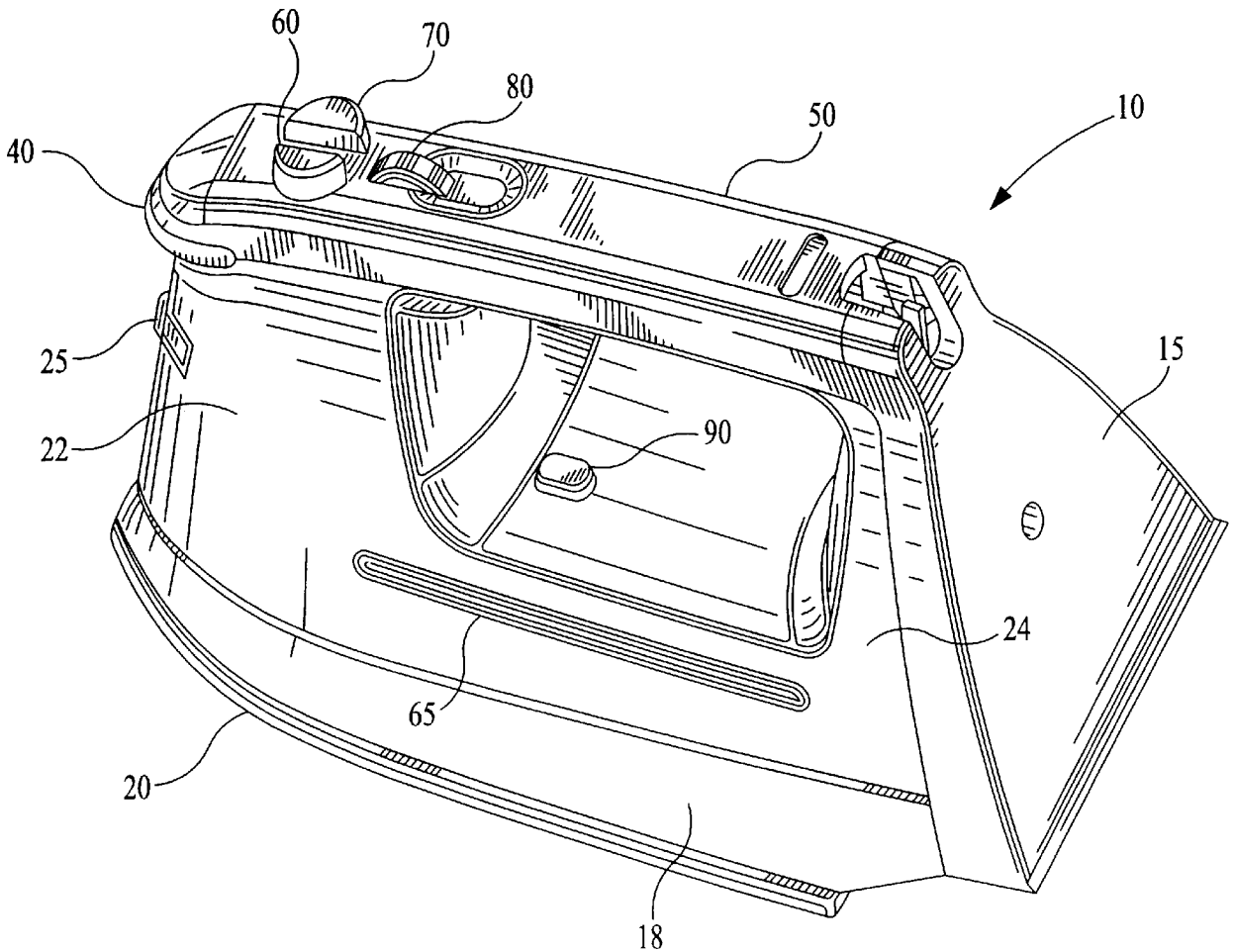
FIG. 1 is a perspective view of an iron constructed in accordance with a preferred embodiment of the present invention, resting on its sole plate.
Figure 2:
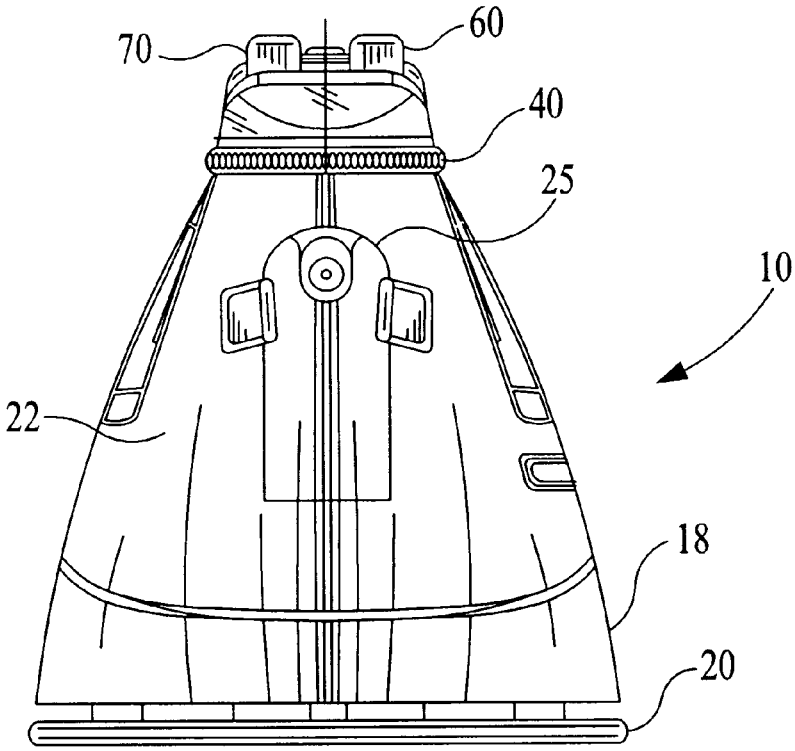
FIG. 2 is a front view of the iron of FIG. 1.
Figure 3:
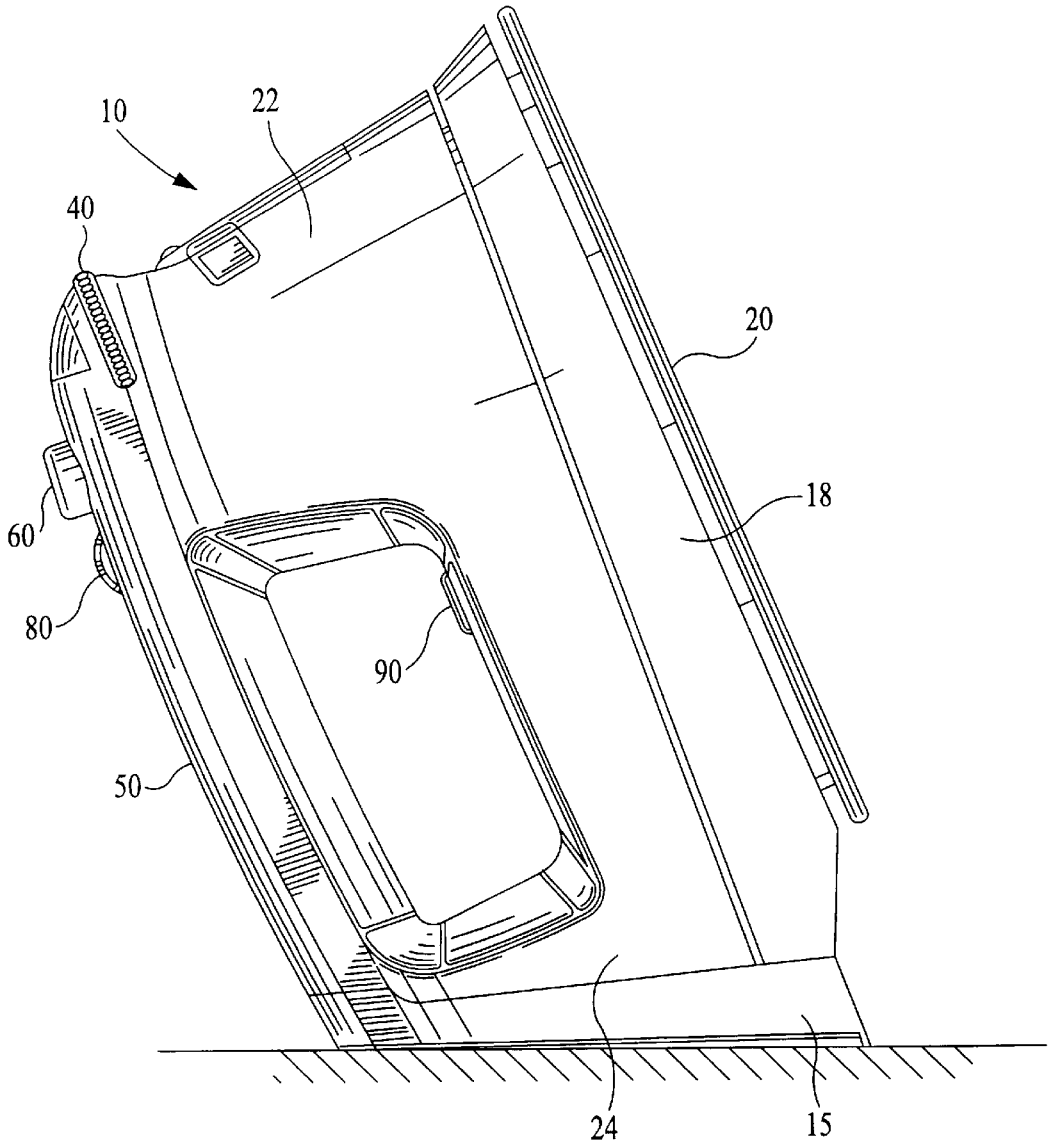
FIG. 3 is a side view of the iron of FIG. 1 resting on its heel in a vertical orientation.

FIGS. 1–3 illustrate an iron 10 according to the present invention. The iron 10 includes a base 18, a sole plate 20 coupled to the base 18, a handle 50, a forward pedestal 22, and a rear pedestal 24. The rear pedestal 24 cooperates with the base 18 to define a heel 15.

FIG. 1 shows the iron 10 in a horizontal position resting on the sole plate 20. The sole plate 20 may be heated and pressed against fabric to remove wrinkles. The user grips the iron 10 by the handle 50 to press the sole plate 20 onto a fabric and move the iron 10 across the fabric's surface. FIG. 3 shows the iron in a vertical position and resting on its heel 15. The iron 10 can be rested on the heel 15 when it is not in use.

Figure 4:
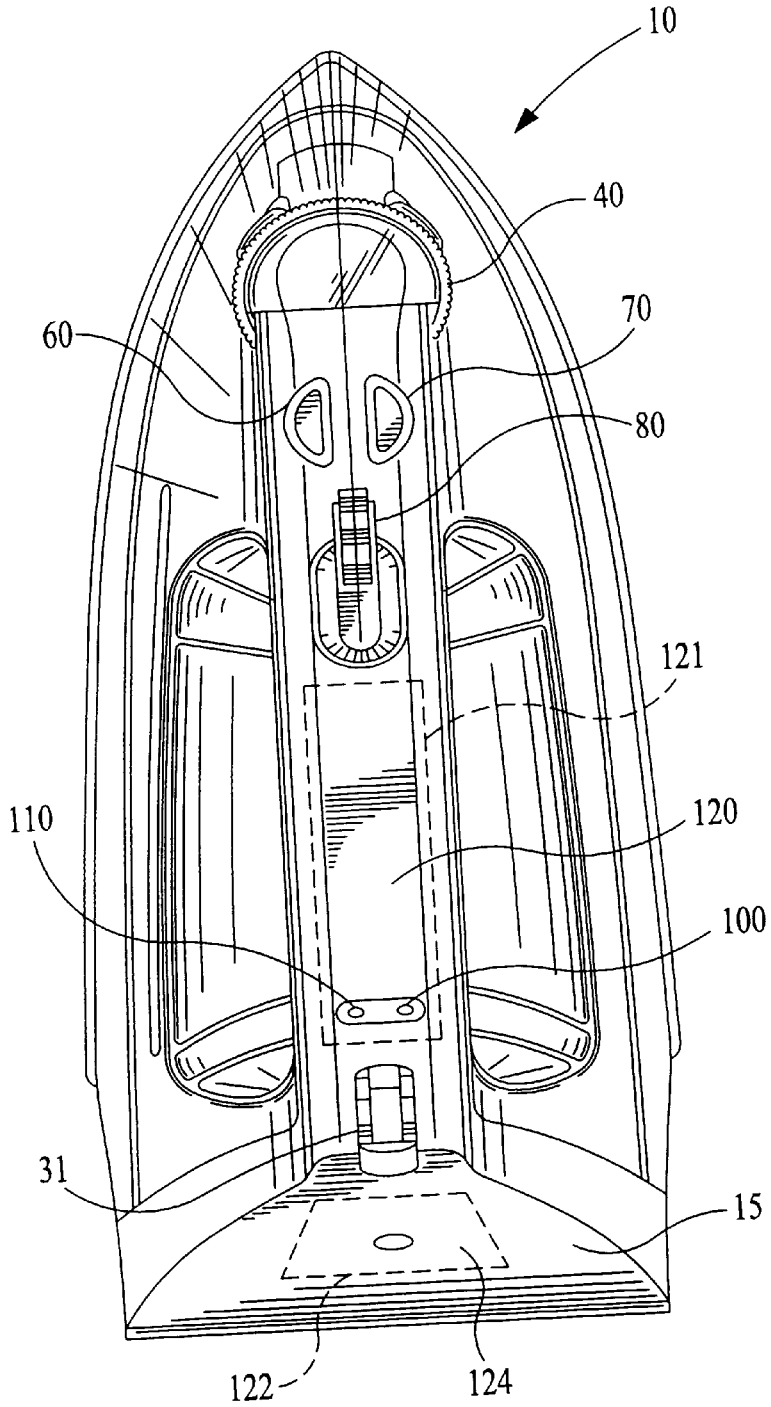
FIG. 4 is a top view of the iron of FIG. 1.

A temperature control dial 40, for turning the iron 10 on and off and for adjusting the temperature of the sole plate 20 may be located on the handle 50 adjacent the forward pedestal 22. A steam control button 60 for spraying steam from sole plate 20, a water control button 70 for spraying water from the nozzle 25, and a rotary dial 80, for controlling the amount of steam or water sprayed upon depression of the buttons 60, 70, are disposed on the top of the handle 50. A red light emitting diode ("LED") 100 and a green light emitting diode 110 are disposed in the handle 50 adjacent the cord pivot 31 for indicating the condition of the iron (FIG. 4). As will be further explained below, the red light emitting diode 100 is illuminated when the iron 10 is in use and the green light emitting diode 110 is illuminated when an auto shut off feature is activated. The base 18 includes a water gage 65 for determining the level of water inside the iron 10 and a self-clean button 90 for initiating a self-cleaning process.

The iron 10 includes an automatic shut-off circuit 200 disposed in area 121 of the handle and area 122 of the heel 15. The area 121 defines the space in which a first circuit board 120 is placed. The circuit board 120 includes the red and green light emitting diodes 100, 110 and a pendulum switch 330. The light emitting diodes can be seen through a clear plastic portion of the handle 50. Area 122 defines a space for a second circuit board 124. The second circuit board 124 includes portions of the automatic shut-off circuit 200 which are too large to be placed in the handle 50. The first and second circuit boards 120, 124 are connected by wires (not shown) housed within the iron 10.

Figure 5:
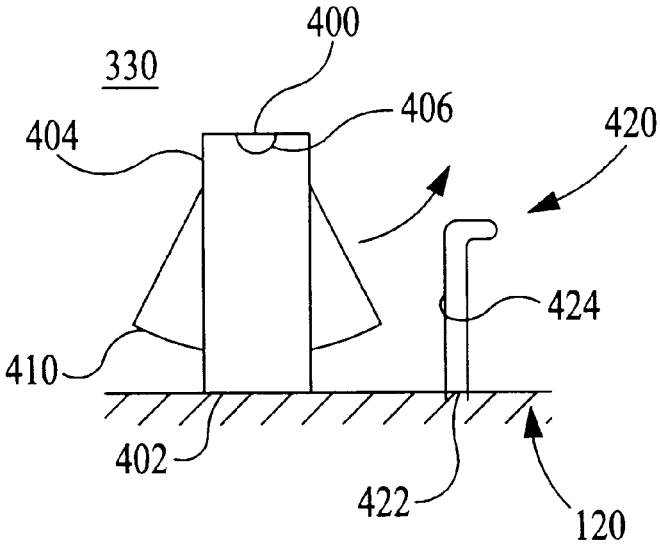
FIG. 5 is a side view of a pendulum switch for the iron of FIG. 1.

FIG. 5 illustrates the orientation switch 330. The orientation switch is used to sense whether the iron 10 is in the horizontal or vertical position. In the embodiment illustrated, a pendulum switch 330 employs a pendulum actuator 410. Other types of actuating switches include mercury switches and ball switches. The switch 330 is positioned on the circuit board 120, and includes a pendulum stand 400, a pendulum 410 and a switch contact 420. The pendulum stand 400 includes a base 402 attached to the circuit board 120, a pivot support 404 extending upwardly from the base 402, and a pivot pin 406 positioned at the top of the pivot support 404. The switch contact 420 includes a base 422 attached to the circuit board 120 and a contact member 424 projecting upwardly from the base 422. The pendulum stand 400 is located adjacent the switch contact 420. When the iron 10 moves to its vertical position, resting on the heel 15, the pendulum 410 pivots by gravity into contact with the switch contact 420, closing the pendulum switch 330. When the iron 10 is in the horizontal position, on the sole plate 20, the pendulum 410 does not touch the contact 420, and the switch 330 is open. During the ironing process, when the iron 10 is being moved back and forth across a piece of clothing or other fabric, gravity pulls the pendulum 410 downwardly away from the contact 420 so that any contact between the pendulum 410 and the contact 420 is only momentary. Hence, the switch 330 remains closed only when the iron 10 is placed in the upright position, resting on the heel 15. The operation of switch 330 in the automatic shutoff circuit 200 will be described in more detail below.

Figure 6:
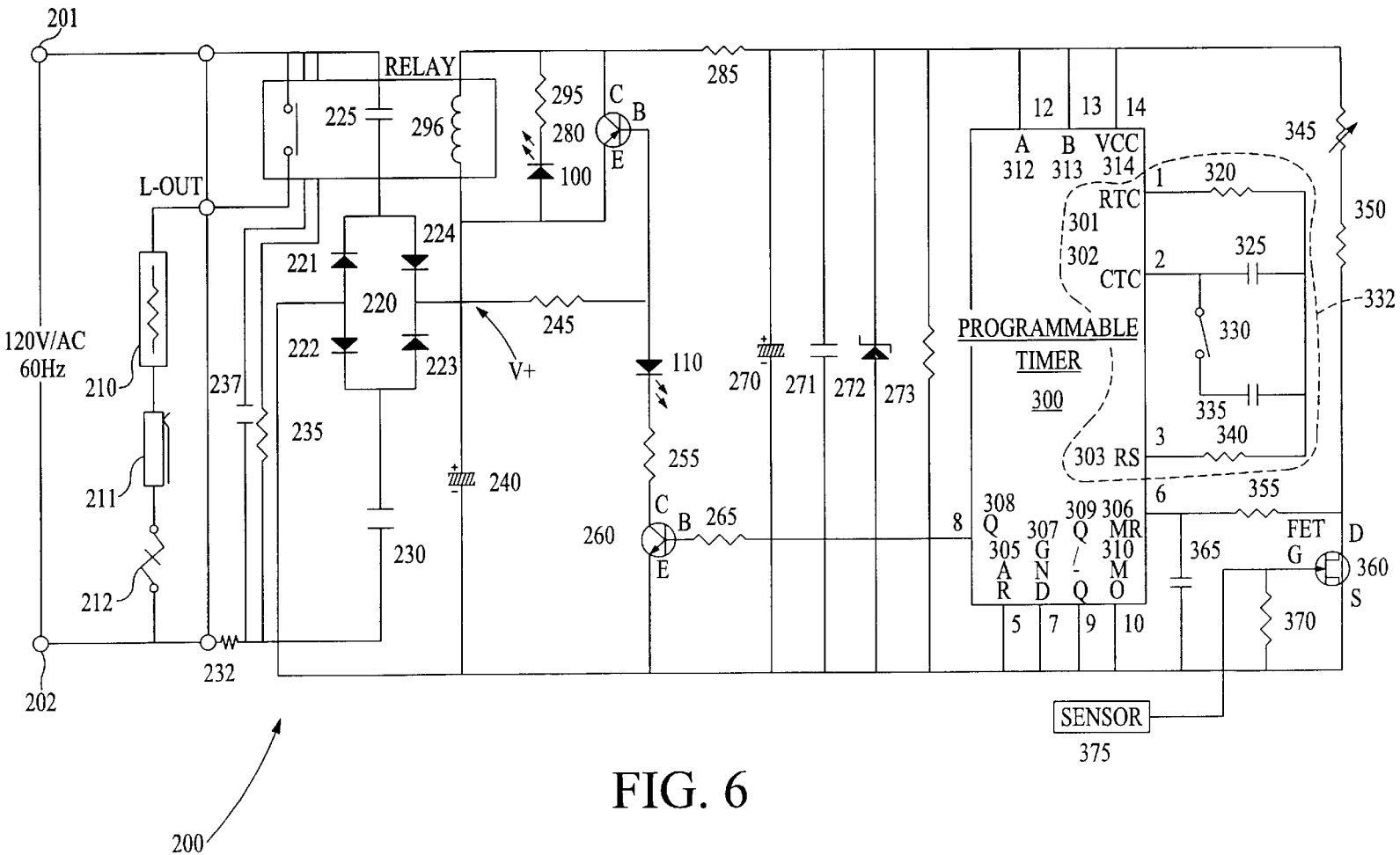
FIG. 6 is a circuit diagram of the controlling circuit for the iron of FIG. 1.

FIG. 6 is a diagram of the circuit 200 used to control the automatic shut off feature for disabling the iron 10. Power is supplied to a relay 296 of an automatic shut off control circuit 200. The relay 296 is controlled by the output of a programmable timer 300. As long as a user grasps the handle of the iron 10, the timer outputs a signal that allows the relay 296 to pass current to the heater 210, the thermostat 211, and the fuse 212. When the user removes his hand from the handle 50, the timer 300 begins to count down a predetermined number of counts. When the countdown expires, the programmable timer 300 sends a signal that turns off the relay 296, removing power from the heater 210, thermostat 211 and the fuse 212 and disabling the iron 10. The number of counts depends on whether the iron 10 is in the horizontal or vertical orientation, as determined by the orientation switch 330.

Power is supplied to the control circuit 200 through a line input 201 and a neutral input 202. The automatic shut off control circuit 200 outputs power, as described in more detail below, to a heater 210, a thermostat 211, and a fuse 212, arranged in series. The heater 210 heats the sole plate 20 of the iron 10.

The input 201 to the automatic shut off control circuit 200 is connected to one side of a diode rectifier bridge 220, containing diodes 221–224, through a capacitor 225. The other side of the diode rectifier bridge 220 is connected to the neutral line 202 of the power source through a capacitor 230 and resistor 232. The diode rectifier bridge 220 creates a ground at the connection between diodes 221, 222, and a positive DC potential at the connection between diodes 223, 224 (node V+). The positive DC potential is connected to ground through a capacitor 240, and is also connected to a resistor 245 which has its opposite end connected to ground through a green light emitting diode 110, a resistor 255, and a transistor 260 that are connected in series. The base of the transistor 260 is connected to the Q output 308 of the timer 300 through the resistor 265. Finally, the DC potential "V+" is connected to a timer 300 through a relay coil 296 and a resistor 285. Connected in parallel between thc rectifier bridge 220 and the power source arc resistor 235 and capacitor 237.

Connected in parallel across the relay coil 296 is red light emitting diode 100 and a resistor 295 connected in series. The series-connected red light emitting diode 100 and resistor 295 arc connected across the emitter and collector terminals of a PNP transistor 280. Although a PNP transistor is used in this particular embodiment, other types of transistors (i.e. NPN) may also be used. The base of the transistor is connected to the power supply V+ potential through resistor 245 while the collector of the transistor 280 is connected to a resistor 285. The other end of the resistor 285 provides connections to terminals 312, 313, and 314 of the timer circuit 300. Two capacitors 270 and 271, Zener diode 272, and resistor 273 are connected in parallel between the resistor 285 and the timer 300 to provide AC blocking elements which serve to protect the timer 300 from random AC pulses.

A programmable timer 300, such as a Motorola MC14541B, controls the auto shut off circuitry. Ground is supplied to the input 307 of the programmable timer 300. The auto-reset input 305, Q/Q' select input 309, and mode input 310 of the timer 300 arc also connected to ground. The power supply potential is supplied to the Vcc terminal 314 of the timer 300. The A input terminal 312 and B input terminal 313 of the timer 300 are also tied to the power supply potential. A resistor 320 has one end connected to RTC input 301 of the timer 300. The other end of the resistor 320 is connected to a capacitor 325 which has its opposite end connected to the CTC input 302 of the timer 300. Connected in parallel with capacitor 325 is another capacitor 335. This capacitor 335 is selectively coupled to the capacitor 325 by a switch 330. The end of the capacitor 335 not connected to the switch 330 is connected to a resistor 340 which has its opposite end connected to the RS input 303.

A master reset input 306 of the timer 300 is connected to the Vcc power supply potential through resistors 350 and 355 connected in series with potentiometer 345. One end of resistor 355 and master reset input 306 are connected to ground through a capacitor 365. The other end of resistor 355 is connected to the drain D of an N Channel FET 360. The gate G of the FET 360 is connected to a sensor 375 and to ground through a resistor 370. The source S of the FET 360 is also connected to ground.

The FET 360 has a sensor 375 connected to and biasing its gate G. The sensor 375 includes a metal plate 510 (FIG. 7) which is secured to the handle 50 of the iron 10. The metal plate 510 forms a capacitor with the user, when the user grasps the handle 50 of the iron 10. In particular, the metal plate 510 operates as the bottom plate of a capacitor, the user's hand or body operates as the top plate of the capacitor, and the plastic portion of the handle located between the user and the metal plate operates as the dielectric. The capacitive current which forms is then used to bias the gate G of the FET 360 to the operating position. When the gate G is biased current is permitted to flow from the source S to the drain D of FET 360. When the current flows in this way the master reset pin 306 is held "HIGH" (a logic "1"), which prevents the timer 300 from counting. However, when the user releases the handle, current can no longer flow through the FET 360, and instead flows through resistor 355 and capacitor 365. When the current flows in such a manner the master reset pin 306 will be held "LOW" (a logic "0"), and the master reset will not be actuated.

The master reset 306 will always be "HIGH" as long as the user is grasping the handle. This prevents the timer from counting, and ensures that the timer 300 always outputs a logic "0" from the Q output 308. When the handle is no longer being grasped, the master reset 306 goes "LOW," which causes the timer to start one of the two predetermined timing periods. At the end of the predetermined timing period, the Q output 308 outputs a logic "1", which serves to prohibit the heater 210 from heating the sole plate 20 of the iron 10. This occurs because when the Q output 308 goes "HIGH", the base B of transistor 260 is biased on, which forces the current formed at node "V+" to travel through resistor 245, green light emitting diode 110, and resistor 255 to ground. When the current travels in this direction, the relay coil is not actuated and therefore no current flows through the heater 210, the thermostat 211, and the fuse 212.

The resistors 320, 340 and capacitors 325, 335 control the two timing periods. The resistors 320, 340 and capacitors 325, 335 create a timing circuit 332 with a time constant defined by the parameters of these individual elements. The larger the value of the capacitor, the longer the timing period will be. As can be seen in FIG. 6, when the switch 330 is closed the timing circuit 332 includes both capacitors 325, 335 in parallel. When the switch 330 is open, the timing circuit 332 only includes capacitor 325. Therefore, a longer timing period will be actuated when the switch 330 is in the closed position. Namely, the timing circuit 332 will count down about fifteen minutes before turning off the iron when the switch is closed, but will only count down about thirty seconds before turning off the iron when the switch is open.

When the iron 10 is in the upright vertical position the switch 330 is closed and the output 308 of the timer 300 becomes a logic "1" after fifteen minutes. When the iron 10 is in the horizontal position, the switch 330 is open and the timer 300 outputs a logic "1" at the Q output 308 after thirty seconds. The two different timing periods arc set by the discharging times of the capacitors 325 and 335. In preferred embodiments, capacitor 325 is relatively small (about 1000 pf) and discharges in about 30 seconds. Capacitor 335 on the other hand is preferably larger than capacitor 325 (about 0.027 microfarads). When capacitor 335 is coupled into the circuit by switch 330, the timing period becomes much larger, approximately fifteen minutes. The time durations can vary. For example, the thirty second time duration can range from about five seconds to about seventy five seconds or more and the fifteen minute time period can range from about five minutes to about sixty minutes or more.

The output 308 of timer 300 is connected to the base of NPN transistor 260 through resistor 265. The emitter F of transistor 260 is tied to ground and the collector C is attached to DC potential through resistor 255, green light emitting diode 110, and resistor 245. Thus, when the output 308 of the timer 300 goes high (a logic "1") current can flow from the DC potential through the resistor 245, the green light emitting diode 110, and resistor 255 to the collector C of the transistor and through to the emitter E. When the output 308 of the timer 300 is low current does not flow through the leg of the circuit containing green light emitting diode 110, resistor 255, and transistor 260. Instead, current flows from the DC potential (node V+) through the resistor 245 to the base B of transistor 280. The bias voltage created at the base of the transistor 280 allows current to flow from the emitter E to the collector C. Current also flows through relay coil 296, red light emitting diode 100, and resistor 295. The application of current through relay coil 296 causes the relay to close and apply power to the heater 210, thereby heating the sole plate 20.

Figure 7:
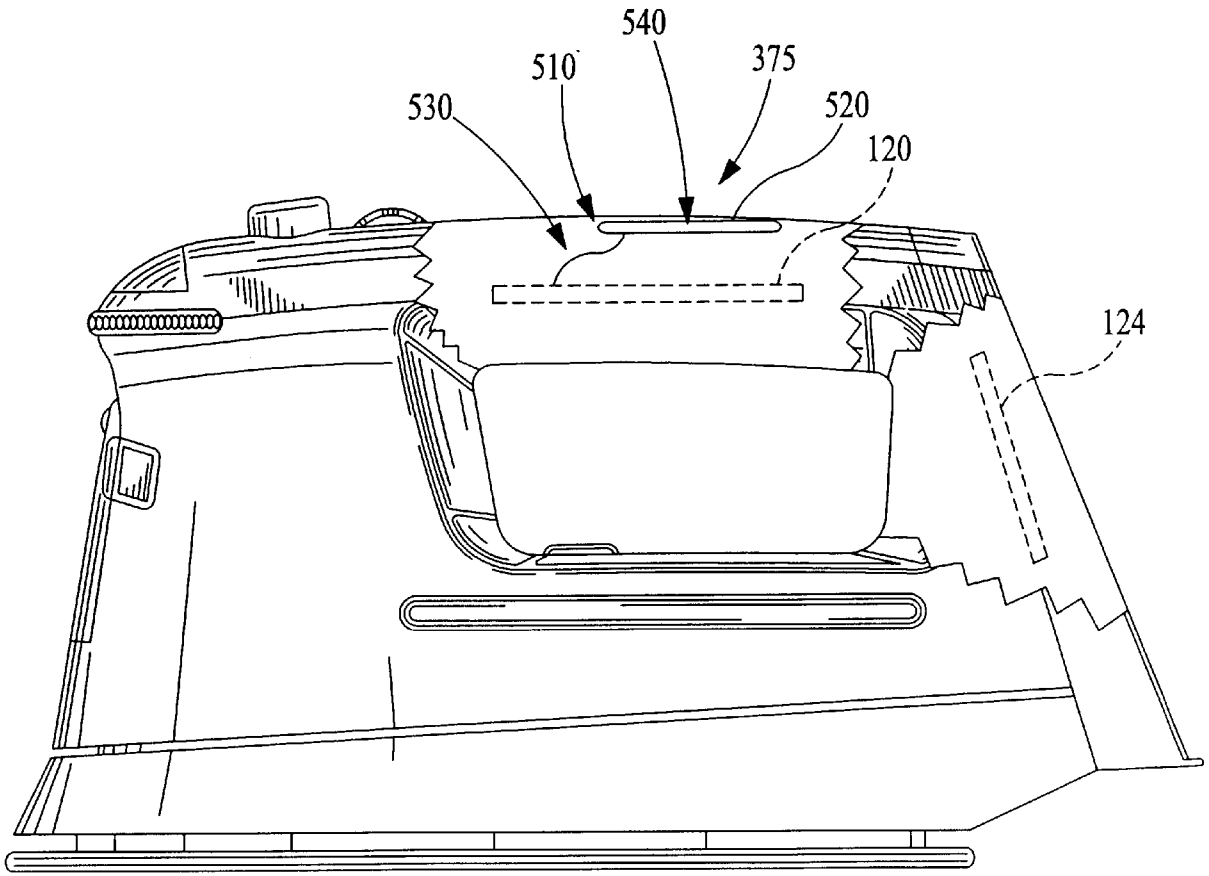
FIG. 7 is a partial side view of the iron of FIG. 1 with portions of the handle cut away to reveal components of the hand sensor.

FIG. 7 shows the sensor 375. The circuit board 120 is placed within the handle 50 of the iron 10. A metal plate 510 is preferably secured to the inner surface of the handle (as shown) by glue, tape or other adhesive means. This metal plate 510 is attached to the circuit board 120 by a wire 530, and acts as the bottom plate of a capacitor. The top plate of the capacitor is formed by the portion of a user's hand or body that touches the top portion 540 of the handle 50. A portion of the handle 520 that separates the metal plate 510 from the exterior of the iron acts as a dielectric between the two plates of the capacitor. As shown in the FIG. 7, the portion 520 does not necessarily extend all the way to the metal plate 510, and therefore an air gap can exist therebetween, although an air gap is not required. In this manner, whenever any portion of the user's body comes close to the top portion 540 the capacitor will be formed and a small capacitive current will be supplied to the circuit 200. Although the best connection is formed when the user's hand is wrapped completely around the handle because the contact area is large, merely touching the handle 50 with the tip of the user's index finger may also activate the auto shutoff feature. As described above, this small capacitive current is used to bias the gate G of a FET 360, and render the FET conductive from source S to drain D.

In operation, the iron is turned on and voltage is applied across the terminals 201, 202. The relay coil 296 is actuated and alternating current flows through heater 210, thermostat 211, and fuse 212. If the handle 50 is not being grasped at the time the iron is turned on, one of the two timing periods will also begin to count down depending on the position of the pendulum switch 330. AC current also flows into diode rectifier bridge 220 where it is converted to DC, current at node "V+" between diodes 223 and 224. This DC current flows to the portion of the circuit containing red light emitting diode 100, through resistor 285 and on to the timer 300 when the iron 10 is in its normal mode of operation (i.e. when the user is ironing a piece of clothing and grasping the handle of the iron). Thus, when the iron 10 is operating normally, red light emitting diode 100 is illuminated.

When the user lets go of the handle 50, current no longer flows through the FET 360, but instead flows through resistor 355 and capacitor 365. This causes the master reset 306 input of the timer 300 to go "LOW" (logic "0"), and one of the two timing periods begins to expire. At the end of the timing period, the timer 300 outputs a HIGH (logic "1") signal from the Q output 308. This provides a signal to the base B of transistor 260 which allows current to flow from the collector C to the emitter E. When this occurs, current no longer flows through the portion of the circuit containing red light emitting diode 100 and the relay coil 296, but instead flows through the portion of the circuit containing green light emitting diode 110. When current is no longer flowing to the relay coil 296, the relay opens and the voltage applied across the heater 210 is removed. Thus, when the power to the sole plate 20 is switched off, the green light emitting diode 110 will be illuminated. When the user again grasps the handle 50 the master reset 306 is again actuated, and current begins to flow again in the portion of the circuit containing the red light emitting diode 100.

Figure 8:
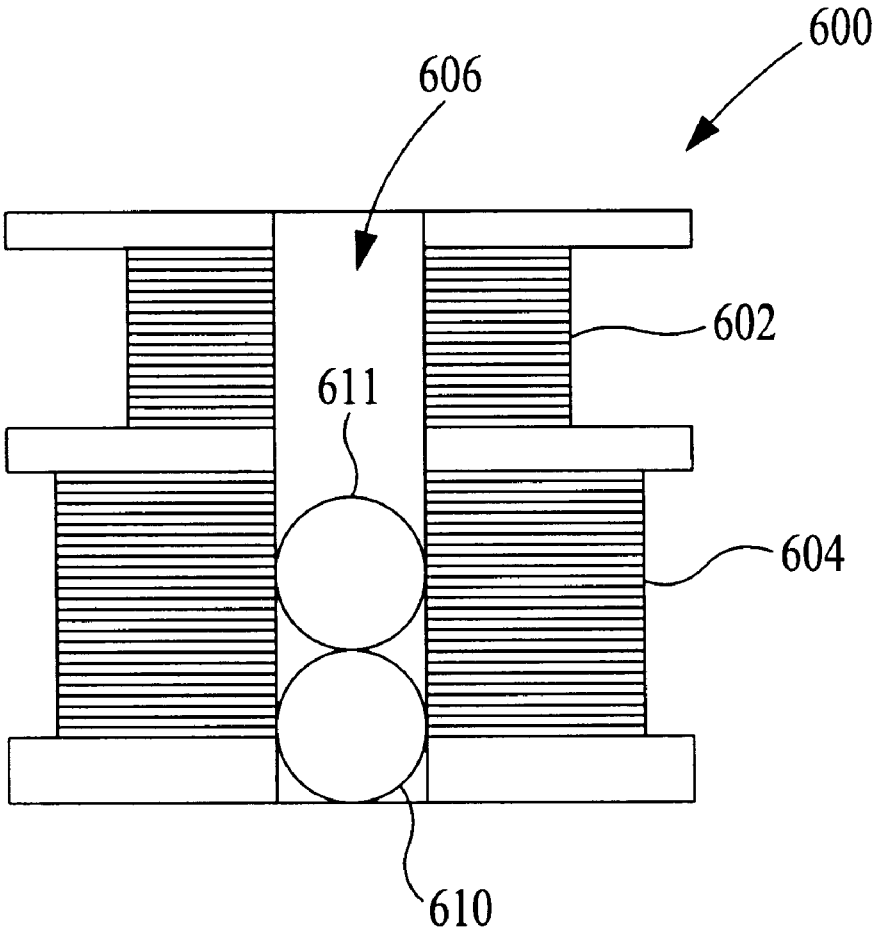
FIG. 8 is a side view of a coil switch for use in another preferred embodiment of the invention.
Figure 9A:
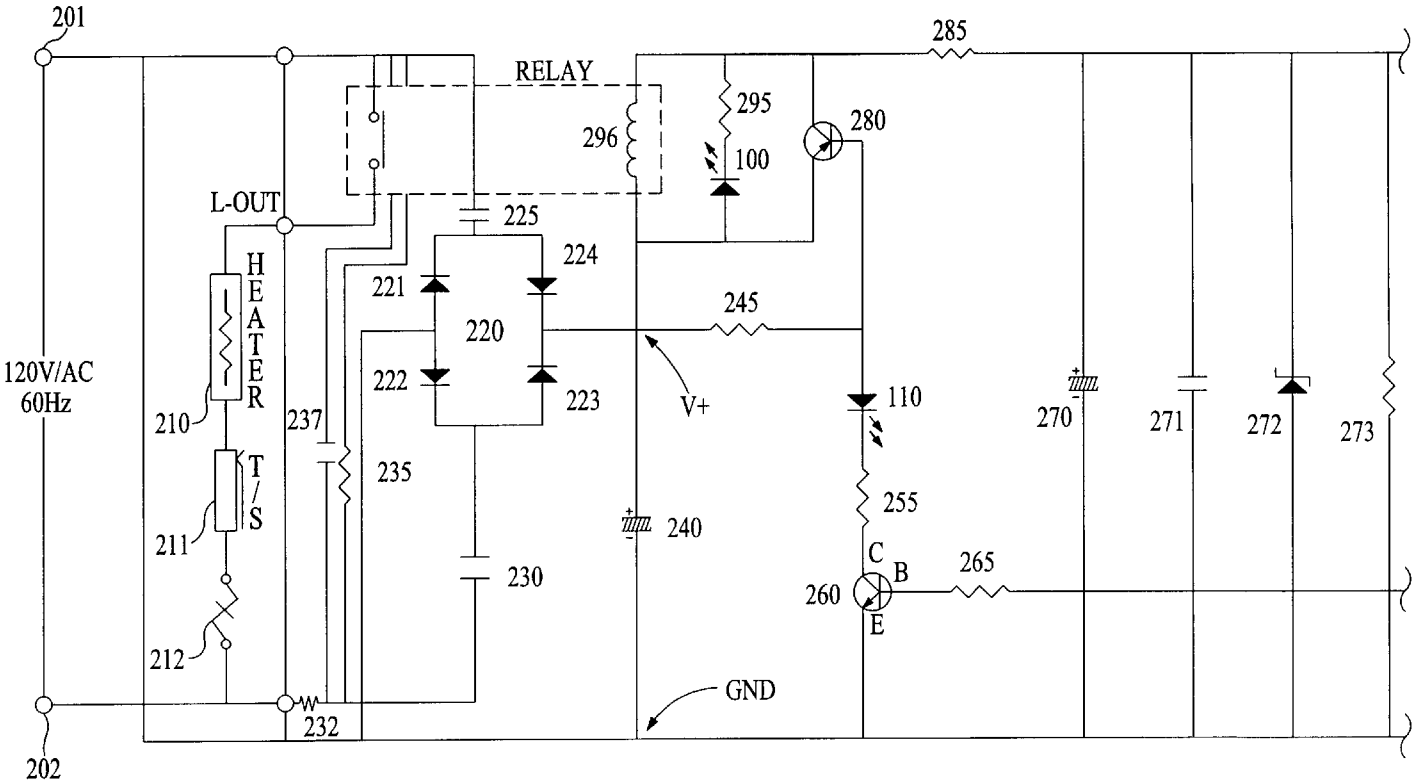
FIGS. 9A and 9B respectively depict left and right portions of FIG. 9.
Figure 9:
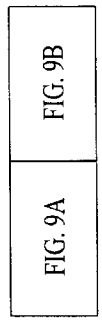
FIG. 9 is a circuit diagram of the controlling circuit for the embodiment of FIG. 8.
Figure 9B:
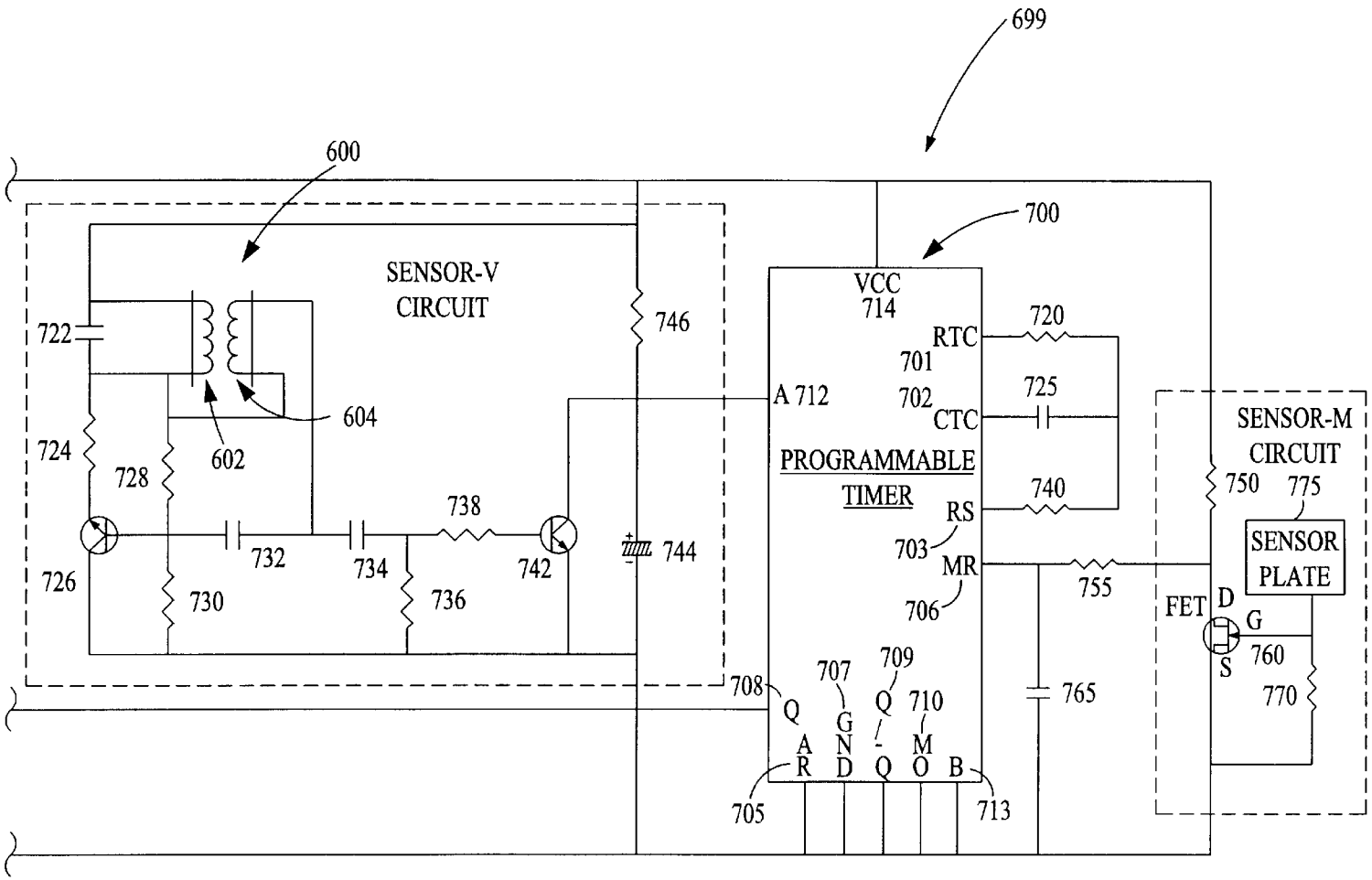

Another embodiment of the invention is illustrated in FIGS. 8 and 9. Referring to FIG. 8, the invention can include a coil switch 600. The coil switch 600 includes a primary coil 602 and a secondary coil 604 mounted axially adjacent each other with the primary coil 602 mounted above the secondary coil 604 when the iron 10 is in the horizontal orientation. The coils 602, 604 share a common hollow core 606. A pair of steel balls 610, 611 is disposed in the core 606 for movement between the coils 602, 604. When the iron 10 is in the vertical orientation, the two balls 610 rest within the primary coil 602, and a first signal having a first frequency f0 is induced in the secondary coil 604. When the iron 50 is in the horizontal position, as when it is being used, gravity forces the balls 610 out of the primary coil 602 and into the secondary coil 604. When the balls 610 move out of the primary coil 602, a second signal is induced in the secondary coil 604. In preferred embodiments, the second signal has a frequency equal to zero or, in other words, is the absence of the first signal.

FIG. 9 is a diagram of a circuit 699 used in conjunction with the coil switch 600 to control the automatic shut off feature of the iron. Like elements from the circuit 200 of FIG. 6 will be referenced by the same numerals.

Power is supplied to the automatic shut off control circuit 699 through the line and neutral inputs 201 and 202, respectively. The automatic shut off control circuit 699 outputs power, as described in detail below, to a heater 210, a thermostat 211, and a fuse 212, arranged in series. The heater 210 heats the sole plate 20 of the iron 10.

The input 201 to the automatic shut off control circuit 699 is connected to one side of a diode rectifier bridge 220, containing diodes 221–224, through capacitor 225. The other side of the diode rectifier bridge 220 is connected to the neutral line of the power supply through a capacitor 230 and a resistor 232. The diode rectifier bridge 220 creates a ground at the connection between diodes 221, 222, and a positive DC potential at the connection between diodes 223, 224 (node V+). The positive DC potential is connected to ground through a capacitor 240, and is also connected to a resistor 245 which has its opposite end connected to ground through a green light emitting diode 110, a resistor 255, and a transistor 260 that are connected in series. The base of the transistor 260 is connected to the Q output 708 of the timer 700 through the resistor 265. Finally, the DC potential is connected to the timer 700 through a relay coil 296 and a resistor 285. Connected in parallel between the rectifier bridge 220 and the power source are resistor 235 and capacitor 237.

The red light emitting diode 100 is connected in series with a resistor 295. The series-connected red light emitting diode 100 and resistor 295 are connected in parallel across the relay coil 296 and are connected across the emitter and collector terminals of a PNP transistor 280. Although a PNP transistor is used in this particular embodiment, other types of transistors (e.g., NPN) may also be used. The base of the transistor is connected to the power supply potential through resistor 245 while the collector of the transistor 280 is connected to a resistor 285. The other end of resistor 285 provides connections to the Vcc terminal 714 of the timer circuit 700. Two capacitors 270 and 271, Zener diode 272, and resistor 273 are connected in parallel between the resistor 285 and the timer 700 to provide AC blocking elements which serve to protect the timer 700 from random AC pulses.

Still referring to FIG. 9, a first end of a primary coil 602 of a transformer 600 is connected to the one side of capacitor 722 and to resistor 746. A second end of coil 602 is connected to the other side of capacitor 722 and to one end of resistor 724. The opposite end of resistor 724 is connected to the emitter of transistor 726. The base of transistor 726 is connected to one end of resistors 728 and 730 and to one side of capacitor 732, and the collector of transistor 726 is connected to ground. The other end of resistor 728 is connected to the second end of the primary coil 602 and to a second end of the secondary coil 604. The other end of resistor 730 is connected to the emitter of transistor 742. The opposite side of capacitor 732 is connected to one side of capacitor 734. The first end of a secondary coil 604 of the transformer 600 is connected between capacitors 732 and 734. The opposite side of capacitor 734 is connected through resistor 738 to the base of transistor 742 and through resistor 736 to the emitter of transistor 742. The collector of transistor 742 is connected to resistor 746, one side of capacitor 744, and to the "A" input 712 to the timer 700. The emitter of transistor 742 is connected to the opposite side of capacitor 744, which is also connected to ground.

A programmable timer 700, such as a Motorola MC14541B, controls the auto shut off circuitry. Ground is supplied to the GND input 707 of the programmable timer 700. The auto-reset input 705, Q/Q' select input 709, and mode input 710 of the timer 701 are also tied to ground. The power supply potential is supplied to the Vcc terminal 714 of the timer 700. The A input terminal 712 is tied to the collector of transistor 742 and B input terminal 713 of the timer 700 is tied to ground. A resistor 720 has one end connected to RTC input 701 of the timer 700. The other end of resistor 720 is connected to a capacitor 725 which has its opposite end connected to the CTC input 702 of the timer 700. A resistor 740 has one end connected to the Rs input 703 of the timer 700, with the other end of the resistor 740 connected between capacitor 725 and resistor 720.

The master reset input 706 of the timer 700 is connected to the power supply potential through resistors 750, 755 connected in series. One end of the resistor 755 and master reset input 706 are connected to ground through a capacitor 765. The other end of the resistor 755 is connected to the drain D of an N Channel FET 760. The gate G of the FET 760 is connected to a sensor 775 and to ground through a resistor 770. The source S of the FET 760 is also connected to ground.

The sensor 775 is substantially similar, in structure and operation, to the sensor 375 as shown in FIG. 7 and discussed in detail above. In particular, the metal plate 510 forms a capacitor with the user, when the user grasps the handle 50 of the iron 10. In particular, the metal plate 510 operates as the bottom plate of the capacitor, the user's hand or body operates as the top plate of the capacitor, and the portion of the handle located between the user and the metal plate operates as the dielectric. The capacitive current that forms is then used to bias the gate G of the FET 760 to the operating position. When the gate G is so biased current is permitted to flow from the source S to the drain D of FET 760. When the current flows in this way the master reset pin 706 is held "HIGH" (a logic "1"), which prevents the timer 700 from counting. However, when the user releases the handle, current can no longer flow through the FET 760, and instead flows through resistor 755 and capacitor 765.

When the current flows in such a manner the master reset pin 706 will be held "LOW" (a logic "0"), and the master reset will not be actuated. The master reset 706 will always be "HIGH" as long as the user is grasping the handle. This prevents the timer from counting, and ensures that the timer 700 always outputs a logic "0" from the output 708. When the handle is no longer being grasped, the master reset 706 goes "LOW", which causes the timer to start one of the two predetermined timing periods. At the end of the predetermined timing period, the output 708 outputs a logic "1", which serves to prohibit the heater 210 from heating the sole plate 20 of the iron 10. This occurs because when the output 708 goes "HIGH", the base B of transistor 260 is biased on, which forces the current formed at node "V+" to travel through resistor 245, green light emitting diode 110, and resistor 255 to ground. When the current travels in this direction, the relay coil 296 is not actuated and therefore no current flows through the heater 210, the thermostat 211, and the fuse 212.

When the iron is in the vertical position, the two balls 610, 611 within the coil switch 600 rest within the primary coil 602, and when current flows through the primary coil 602, a first signal having a frequency f0 is induced in the secondary coil 604. The presence of this induced frequency produces a logic "0" at the A input 712 of the timer. When the iron is in the horizontal position, as when it is being used, gravity forces the balls 610,611 out of the primary coil 602, and the frequency f0 is no longer induced in secondary coil 604. The lack of an induced frequency in the secondary coil 604 produces a logic "1" at the A input 712 of the timer 700.

This logic "0" or "1" produced by the switch 600 is applied to the A input 712 of the timer circuit 700. The B input 713 of the timer 700 is always tied to ground and therefore always receives a logic "0". When the A and B inputs 712, 713, respectively, are both logic "0", the timer 700 counts a specific number of counts. In particular, the Motorola MC14541B programmable timer counts 8192 counts. When the A input 712 is logic "1" and the B input 713 is logic "0", the timer 700 counts a different number of counts. In this situation, the Motorola MC14541B programmable timer counts 256 counts.

The resistors 720, 740 and the capacitor 725, connected to the RTC 701 input, the RS input 703, and the CTC timer input 702, respectively, form an RC circuit that provides a conversion factor that converts the counts into time periods. The conversion factor depends on the values of the resistors and capacitors used. For example, if the resistor 720 is 510 ohm, the resistor 740 is 3.6 Mohm and the capacitor 725 is 0.22 MFD, the RC circuit converts 256 counts into a thirty second time period. The same RC circuit converts 8192 counts into a sixteen minute time period. These timing periods control the amount of time that the output 708 is enabled and, consequently, how long power is supplied to the heater.

Thus, the timer 700 will count down 8192 counts, or about sixteen minutes, when the iron 10 is in the vertical orientation, before turning off the iron 10, assuming that the sensor 775 does not detect the presence of a user's hand. When the iron 10 is in the horizontal orientation, the timer 700 will count down 256 counts, or about thirty seconds before turning off the iron, assuming that the sensor 775 does not detect the presence of a user's hand.

While the invention has been described in detail in connection with preferred embodiments known at the time, it should be readily understood that the invention is not limited to such disclosed embodiments. Rather, the invention can be modified to incorporate any number of variations, alterations, substitutions or equivalent arrangements not heretofore described, but are commensurate with the spirit and scope of the invention.

What is claimed as new and desired to be protected by Letters Patent of the United States is:

1. An iron comprising:

a timer circuit; and a switch for selecting a specified time period of the timer circuit, the switch selecting a first time period when the iron is in a horizontal orientation and a second time period when the iron is in a vertical orientation, the switch being electrically coupled to the timer circuit, said switch including a first coil and a second coil disposed adjacent to the first coil, the first coil inducing a first signal in the second coil when the iron is in the horizontal orientation and inducing a second signal in the second coil when the iron is in the vertical orientation.

2. The iron of claim 1, further including a sensor electrically coupled to the timer circuit for sensing the presence of a user's hand, the user's hand supplying current to the gate of a transistor, the current resetting the specified time period.

3. The iron of claim 1, wherein the first signal includes a logical one input to the timer circuit and the second signal includes a logical zero input to the timer circuit.

4. The iron of claim 1, wherein the first coil includes a first hollow core and the second coil includes a second hollow core, the switch further including at least one member movable between the first and second hollow cores, the first coil inducing the first signal in the second coil when the movable member is disposed in the first hollow core and inducing the second signal in the second coil when the movable member is disposed in the second hollow core.

5. The iron of claim 4, wherein the at least one member includes a metal ball.

6. The iron of claim 1, wherein the first signal includes a first frequency and the second signal includes the absence of the first frequency.

7. An iron comprising:

a handle;

a timer circuit;

a time period selector switch electrically coupled to the timer circuit, the selector switch having a first state to select a first specified time period when the iron is in a horizontal orientation and a second state to select a second specified time period when the iron is in a vertical orientation, the time period selector switch comprises a coil switch having a first coil and a second coil disposed adjacent to the first coil, the first coil inducing a first signal in the second coil when the iron is in the horizontal orientation and inducing a second signal in the second coil when the iron is in the vertical orientation; and a sensor disposed in the handle and electrically coupled to the timer circuit for sensing the presence of a user's hand, the user's hand supplying current to the gate of a transistor, the current resetting the selected specified time period.

8. The iron of claim 7, wherein the first coil includes a first hollow core and the second coil includes a second hollow core, the coil switch further including a ball disposed in the first hollow core when the switch is in the first state and being disposed in the second hollow core when the switch is in the second state.

9. The iron of claim 7, wherein the transistor is a FET.

10. The iron of claim 7, wherein the second time period is substantially longer than the first time period.

11. An iron comprising:

a handle;

a sole plate coupled to the handle;

a heater coupled to the sole plate;

a time period selector switch changeable between a first state and a second state, said time period selector switch comprises a coil switch having a first coil and a second coil disposed adjacent to the first coil, the first coil inducing a first signal in the second coil when the iron is in the horizontal orientation and inducing a second signal in the second coil when the iron is in the vertical orientation;

a timer circuit electrically coupled to the selector switch; and a sensor located in the handle and electrically coupled to the timer circuit for sensing the presence of a user's hand, the user's hand supplying current to the gate of a transistor, the transistor resetting a selected time period when said presence of the hand is sensed, the timer circuit selecting the time period in response to the state of the selector switch.

12. The iron of claim 11, wherein the transistor is a FET.

13. The iron of claim 11, wherein the iron has a horizontal inclination and a vertical inclination, the time period selector switch being in the first state and a time period of about 30 seconds being selected when the iron is in the horizontal inclination, the time period selector switch being in the second state and a time period of about 15 minutes being selected when the iron is in the vertical inclination.

14. An iron comprising;

a sole plate;

a sole plate heater coupled to the sole plate;

a handle coupled to the sole plate and grippable by a user's hand;

a timer, electrically coupled to the sole plate heater, for removing power from the heater after expiration of a selected timing period;

a time period selector switch electrically coupled to the timer, the selector selecting a first time period when the iron is in a horizontal orientation and selecting a second time period when the iron is in a vertical orientation, said time period selector switch comprising a coil switch having a first coil and a second coil disposed adjacent to the first coil, the first coil inducing a first signal in the second coil when the iron is in a horizontal orientation and inducing a second signal in the second coil when the iron is in a vertical orientation;

a sensor coupled to the timer for detecting the presence of the user's hand; and a transistor coupled to the sensor, the sensor biasing a gate contact of the transistor in response to the presence of the user's hand, the selected time period being reset in response to the biasing.

15. The iron of claim 14, wherein the selected timing period includes one of a first timing period and a second timing period, the first timing period being selected in response to movement of the iron to a first inclination, and the second time period being selected in response to movement of the iron to a second inclination.

16. The iron of claim 15, wherein the first time period is about 30 seconds, and wherein the second time period is about 15 minutes.

17. An electric clothes iron comprising:

a handle with an upper side and a lower side;

a circuit board located within the handle, the circuit board containing a field effect transistor; and a single flat square metal plate located within the handle disposed in a spaced relationship from the circuit board and connected to the circuit board;

wherein current flows directly from the metal plate to a gate contact of the field effect transistor, the field effect transistor allowing a continuous direct current reset signal to flow to a reset pin of a timer when a user's hand is sensed by square metal plate.

18. A switch for use with an iron that is movable between a first orientation and a second orientation, the switch comprising:

a first coil having a first hollow core;

a second coil having a second hollow core, the second coil being disposed adjacent the first coil with the first and second hollow cores being coaxially aligned; and a movable member disposed for movement between the first and second hollow cores.

* * * * *